US006789493B2

(12) United States Patent
Langh

(10) Patent No.: US 6,789,493 B2
(45) Date of Patent: Sep. 14, 2004

(54) METHOD AND ARRANGEMENT FOR SHIPPING REELS; TWEENDECK AND TWEENDECK ARRANGEMENT IN CARGO SPACE OF SHIP

(75) Inventor: Hans Langh, Piikkiö (FI)

(73) Assignee: Oy Langh Ship Oy, Piikkio (FI)

( * ) Notice: Subject to any disclaimer, the term of this patent is extended or adjusted under 35 U.S.C. 154(b) by 0 days.

(21) Appl. No.: 10/179,189

(22) Filed: Jun. 26, 2002

(65) Prior Publication Data

US 2003/0019412 A1 Jan. 30, 2003

Related U.S. Application Data

(63) Continuation of application No. PCT/FI00/01145, filed on Dec. 22, 2000.

(30) Foreign Application Priority Data

| | | |
|---|---|---|
| Dec. 30, 1999 | (FI) | 19992826 |
| May 25, 2000 | (FI) | 20001261 |
| May 25, 2000 | (FI) | 20001262 |
| Jun. 20, 2000 | (FI) | 20001465 |
| Dec. 11, 2000 | (FI) | 20002713 |

(51) Int. Cl.[7] ..... B63B 25/00
(52) U.S. Cl. ..... 114/72; 108/55.3; 410/49
(58) Field of Search ..... 114/72, 73, 75, 114/76; 108/55.3; 410/47, 48, 49

(56) References Cited

U.S. PATENT DOCUMENTS

| | | | | |
|---|---|---|---|---|
| 2,736,287 A | * | 2/1956 | Kummerman | 114/72 |
| 3,109,402 A | * | 11/1963 | Blomberg et al. | 114/76 |
| 3,291,324 A | * | 12/1966 | Fulcher et al. | 414/142.7 |
| 3,509,845 A | | 5/1970 | Shimada | |
| 3,616,776 A | * | 11/1971 | Anker-Nilsen | 114/76 |
| 3,709,181 A | * | 1/1973 | Papanicolaou et al. | 114/72 |
| 3,937,169 A | | 2/1976 | Dahlin | |
| 3,941,071 A | * | 3/1976 | Aldecoa et al. | 114/72 |
| 3,952,790 A | * | 4/1976 | Leitch | 160/193 |
| 4,004,535 A | * | 1/1977 | Oiern et al. | 114/74 A |
| 4,549,267 A | * | 10/1985 | Drabouski, Jr. | 701/124 |
| 4,625,670 A | * | 12/1986 | Igielska | 114/78 |
| 4,647,928 A | * | 3/1987 | Casey et al. | 340/984 |
| 4,803,940 A | * | 2/1989 | Ebeling et al. | 114/72 |
| 4,890,565 A | | 1/1990 | Kelly et al. | |
| 5,161,703 A | * | 11/1992 | Patton | 211/59.4 |
| 5,413,054 A | | 5/1995 | Collins | |
| 6,231,284 B1 | * | 5/2001 | Kordel | 410/49 |

FOREIGN PATENT DOCUMENTS

| | | |
|---|---|---|
| CH | 7602938-8 | 11/1997 |
| DE | 2 502 106 | 9/1982 |
| DE | 3246331 | 6/1984 |
| DE | 4017918 | 12/1991 |
| EP | 0 091 325 | 10/1983 |
| EP | 0 318 960 | 6/1989 |
| GB | 1119466 | 7/1968 |
| GB | 1543002 | 3/1979 |
| GB | 2 140 359 A | 11/1984 |

* cited by examiner

*Primary Examiner*—S. Joseph Morano
*Assistant Examiner*—Andrew Wright
(74) *Attorney, Agent, or Firm*—Young & Thompson

(57) ABSTRACT

The invention relates to a method and an arrangement for shipping a reel (1) onboard a ship (2) where the reel (1) is at least partly placed into a cargo space (3) of the ship. The arrangement comprises a reel holder (4), which holds the reel (1) placed therein substantially in position at least in the horizontal and downward direction, and the reel holder (4) is arranged onto a tweendeck (5) in the ship's cargo space (3) that is placed at a distance from the bottom (6) of the ship's cargo space, closer to the metacentre of the ship (2) than to the bottom (6) of the ship. The invention also relates to a tweendeck to be used as a transport support for the reel (1) in sea transport and to a tweendeck arrangement in the ship's cargo space (3).

24 Claims, 9 Drawing Sheets

METHOD AND ARRANGEMENT FOR SHIPPING REELS; TWEENDECK AND TWEENDECK ARRANGEMENT IN CARGO SPACE OF SHIP

This is a Continuation of co-pending International Application No. PCT/FI00/01145, filed 22 Dec. 2000, which designated the United States of America.

BACKGROUND OF THE INVENTION

The invention relates to a method for shipping a reel onboard a ship, where the reel is at least partly placed into a cargo space of the ship.

The invention also relates to an arrangement for shipping a reel onboard a ship, where the reel is at least partly placed into a cargo space of the ship.

The invention further relates to a tweendeck to be used as a transport support for a reel in sea transport.

The invention also relates to a tweendeck arrangement in a cargo space of the ship.

The invention is associated with shipping reels, particularly metal-band reels, onboard a ship. However, the method and arrangement of the invention can also be used for shipping different kinds of cylindrical goods.

Such reels are conventionally been transported at the bottom of the ship's cargo space, meaning that the reels are placed directly at the bottom of the cargo space so as to be supported against the walls and the bottom of the cargo space. The reels are locked in relation to one another and also to be immovable regarding the ship by placing the reels on top of each other in such a manner that the reel on the topmost layer is supported on two reels on the layer below. In addition the reels are tied with disposable metal strips. The reels are also supported by pieces of wood.

One of the problems with this conventional arrangement is that the ship loaded with reels, using the conventional way, becomes too stable, and consequently the rolling period of the ship is short.

This is due to the fact that the metacentric height (GM) of the loaded ship is high. In other words the centre of gravity (G) of the loaded ship is relatively close to the bottom of the ship, as the heavy reels are placed at the bottom of the cargo space. The centre of gravity (G) of the loaded ship is therefore far from the metacentre (M) of the ship.

In the conventional arrangement the reels are difficult to place and to tie so that they remain immovably in position in the ship's cargo space during transportation when the ship is subjected to rough seas. Since the metal band reels, in particular, are very heavy, the pieces of wood placed to support the reels are usually crushed when the metal band reels move.

The size of the reels, metal band reels in particular, is also increased. A metal band reel may weigh 30 to 35 tons. This may result in that the largest concentrated load allowed is exceeded at the bottom of the cargo space, since the surface of the metal band reel facing the bottom of the cargo space is generally small. As the reel size is increased it is not safe either to place locking reels between the reels in order to lock the reels in position.

BRIEF DESCRIPTION OF THE INVENTION

It is an object of the invention to provide a method and an arrangement for shipping reels onboard a ship to solve the above problems.

The object of the invention is achieved with a method, characterized by using a reel holder, which holds the reel placed therein substantially in position at least in the horizontal and downward direction, and by the reel holder being arranged onto a tweendeck in the ship's cargo space placed at a distance from the bottom of the ship's cargo space, closer to the metacentre of the ship than to the bottom of the cargo space.

The arrangement of the invention is correspondingly characterized by comprising a reel holder, which holds the reel placed therein substantially in position at least in the horizontal and downward direction, and by the reel holder being arranged onto a tweendeck in the ship's cargo space placed at a distance from the bottom of the ship's cargo space, closer to the metacentre of the ship than to the bottom of the cargo space.

The invention also relates to a tweendeck to be used as a reel transport support for reels in sea transport, characterized by the tweendeck comprising at least one reel holder including means for preventing the reel from moving, said means being arranged to hold the reel placed in the reel holder substantially in position at least in the horizontal and downward direction, and by the tweendeck comprising means for placing the tweendeck in the ship's cargo space at a distance from the bottom of the ship's cargo space, closer to the metacentre of the ship than to the bottom of the ship.

The invention further relates to a tweendeck arrangement that is correspondingly characterized by comprising a tweendeck, which can be placed at a distance above the bottom of the cargo space, and by the tweendeck comprising at least one reel holder for a reel, and by the tweendeck arrangement comprising an arrangement for moving the tweendeck between a storage space and a second position, in which at least one reel can be placed into the reel holder.

The preferred embodiments of the invention are disclosed in the dependent claims.

The invention is based on the idea that heavy reels are placed closer to the metacentre of the ship, more precisely into the reel holders, which are placed on the tweendecks in the top part of the cargo space and which are closer to the metacentre of the ship than to the bottom of the cargo space, to reduce the metacentric height of the ship, since the centre of gravity of the loaded ship moves closer to the metacentre of the ship. As a result the pendulous motion of the ship is reduced and slows down. Simultaneously the strains placed upon the cargo are reduced.

As to the condition and logistics of the cargo the solution of the invention provides the advantage that an appropriate locking reel, which locks the reels to one another at the bottom of the ship's cargo space when placing the reels onto the bottom of the ship, is left out, as the reels are placed into reel holders in the solution of the invention. This also accelerates the loading of the ship. A crane driver loading reels onto the ship and correspondingly unloading reels from the ship has an unobstructed visibility to the loading area, since the reel holders are clearly visible in the ship's cargo space. To place the reels into the reel holders on the tweendecks can be carried out using a programmable crane and an automatic reel grip tong, thus reducing labour costs. The solution of the invention also accelerates the loading and unloading of the ship.

Since the position of an individual reel on a ship is known and the reels are placed into the reel holders, the reels can be removed from the ship in any order, for example in accordance with the wishes of the receiver.

The solution of the invention also provides such an advantage that the reel holders allow the reels to be fastened on the ship for example using such belts that can be used more than once.

The invention further provides such an advantage that the reels remain firmly in the reel holders without any additional supports, thus facilitating the loading and unloading of reels to and from the ship. Since the solution of the invention does not require disposable binders or timber, said solution is environmentally friendly.

In a preferred embodiment of the invention the reels are placed into such reel holders, which are arranged onto the tweendecks placed above the bottom of the ship's cargo space and which are also placed beneath the weather deck of the cargo space. The weather deck is thus able to prevent the reels from being displaced from the reel holders. The reels need not therefore necessarily be separately fastened to the reel holders in this preferred embodiment. As the reels are placed between the tweendeck and the weather deck, they cannot move and are therefore unable to cause danger to the ship. The stevedores do not have to arrange reels or for example wedges or mats into the ship's cargo space, since the reels are simply mounted to the reel holders and thereafter the weather deck is closed in such a manner that the reels remain in the reel holders without separate fastening elements. Since the reels are placed into the reel holders beneath the weather deck, there is no danger of the reels moving and possibly being damaged. As the reels are not separately fastened, the fastening material does not create any waste or expenses.

The solution of the invention also allows to use the ship's cargo space more efficiently, as containers for example can be placed beneath the tweendeck of the ship's cargo space and above the weather deck. The solution of the invention allows the cargo to be appropriately placed on the ship and the ship to be loaded and unloaded always in the same order. The receiver therefore knows in advance what and when cargo is unloaded from the ship. The unloading end can therefore be provided in advance with an appropriate number of suitable equipment. The same naturally applies to the loading end.

The solution of the invention provides economic and environmental advantages. The optimal metacentric height GM of a ship allows to select the route more appropriately, thus reducing petrol consumption and channel fees, for example.

BRIEF DESCRIPTION OF THE DRAWINGS

In the following the invention will be described in greater detail by means of the preferred embodiments with reference to the accompanying drawings in which.

DETAILED DESCRIPTION OF THE INVENTION

Figure 1:
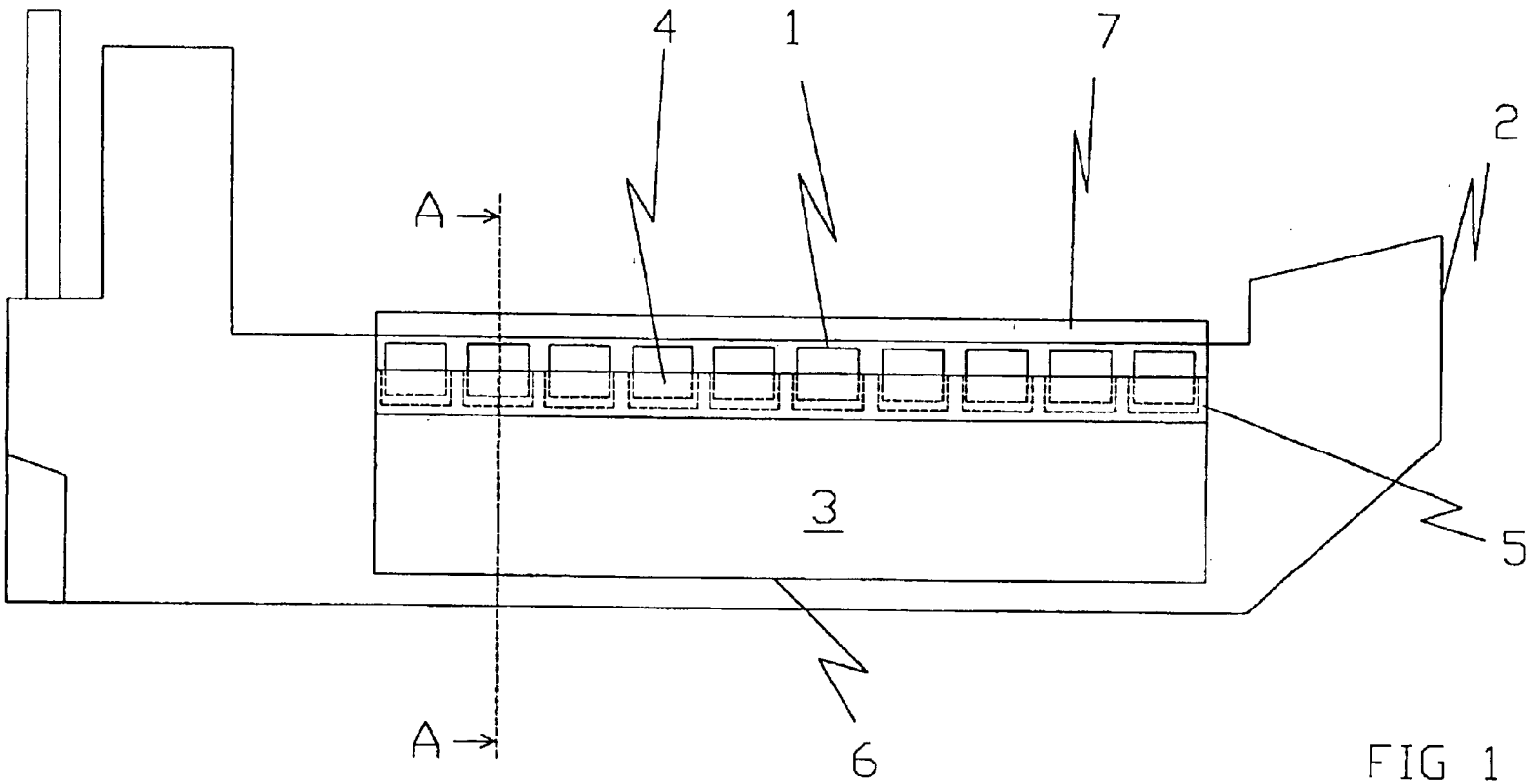
FIG. 1 is a side view of a ship comprising an arrangement of the invention.

FIG. 1 shows an arrangement for shipping reels 1 onboard a ship 2, where the reels 1 are at least partly placed into a cargo space 3 of the ship.

The arrangement of the invention comprises at least one reel holder 4 that keeps the reel 1 placed therein substantially in position at least in the horizontal and downward direction regarding the ship 2. Alternatively, a reel holder 4 may hold the reel 1 in position in a different direction. An individual reel holder 4 may also hold several reels 1 in position. For this purpose, the reel holder 4 comprises means (not indicated with a reference numeral) that prevent the reel from moving.

Figure 3:
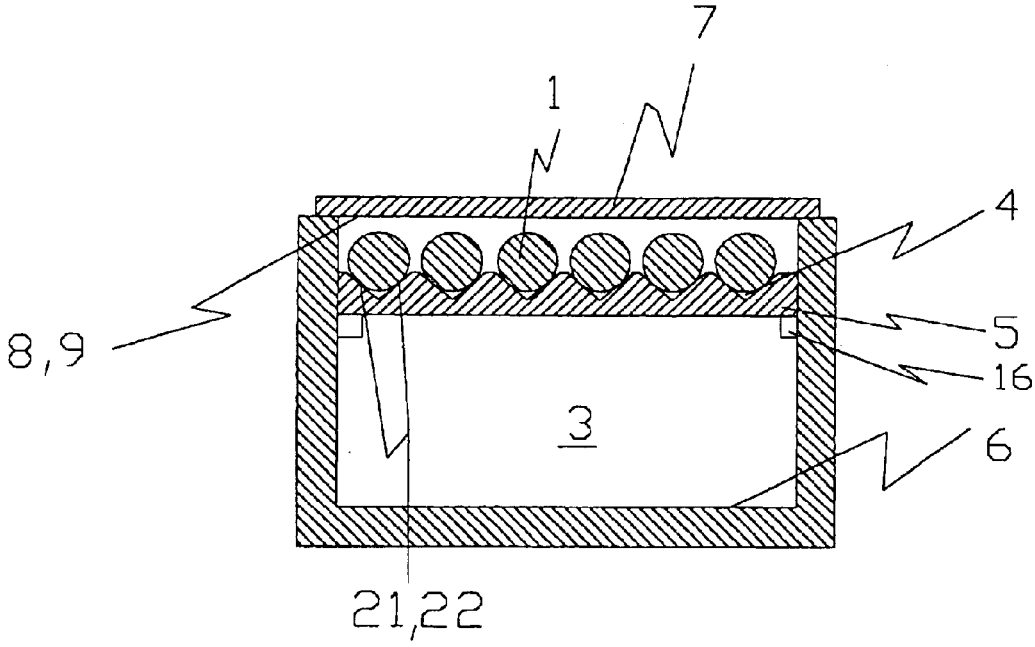
FIG. 3 shows a ship in cross section (along line A—A in FIG. 1) comprising the arrangement of the invention.

In FIG. 3 said means preventing the motion of the reel comprise two surfaces 21 inclining against each other. In FIG. 3 the inclined surfaces 21 are symmetrically placed in relation to the mid-line (not indicated in the Figure) of the reel holder 4, on both sides of the mid-line. Furthermore, said inclined surfaces 21 have a substantially similar angle of deflection. The means preventing the motion of the reel 1 may alternatively comprise arched surfaces (not shown), which are preferably placed in the same way as the inclined surfaces 21 shown in FIG. 3.

The reel holder 4 is arranged onto a tweendeck 5 in the ship's cargo space 3. The tweendeck is placed at a distance from the bottom 6 of the ship's cargo space above the bottom 6 of the cargo space, closer to the metacentre (not shown in the Figure) of the ship 2 than to the bottom 6 of the cargo space.

The tweendeck 5 can preferably be detached from the ship 2 or can be moved using any means so as to obtain, for example the centre of gravity (not shown in the Figure) of the ship, to a desired point. The movable tweendeck 5 allows to place the tweendeck 5 so as to fit more goods into the cargo space 3.

The reel holders 4 are preferably placed onto the tweendeck 5 into at least one line (not indicated by a reference numeral) or in another way symmetrically as regards the ship 2, for example in relation to the longitudinal mid-line (not shown) of the ship. Such an arrangement allows the heavy reels 1 to be symmetrically placed in relation to the ship 2 in such a manner that the balance of the ship 2 is not reduced.

The reel holders 4 are preferably provided with a flexible coating 22 arranged to be placed between the reel holder 4 and the reel 1.

The reel holder 4 is preferably fixedly fastened, for example welded, onto the tweendeck 5.

Alternatively, the reel holder 4 can be detachably fastened onto the tweendeck 5. This allows the reel 1 to be placed and fastened to the reel holder 4 before the reel 1 is lifted together with the reel holder 4 onto the tweendeck 5 in the ship's cargo space 3. The reel holder 4 and a frame structure 5 preferably comprise compatible fasteners (not shown) for locking the reel holders 4 in relation to the frame structure 5.

The reel holder 4 can also be partly formed of a recess on the tweendeck 5 as shown in FIGS. 1 and 3. If the reel holders 4 are formed of the recesses on the tweendeck 5, the space taken by the reel holder 4 and the tweendeck 5 in the cargo space 3 is insignificant.

The tweendeck 5 comprises means for placing the tweendeck 5 in the ship's cargo space 3 at a distance from the bottom 6 of the ship's cargo space, closer to the metacentre of the ship 2 than to the bottom 6 of the cargo space. Said means for placing the tweendeck 5 in the ship's cargo space 3 at a distance from the bottom 6 of the ship's cargo space, closer to the metacentre of the ship 2 than to the bottom 6 of the cargo space, are formed in the Figures of the tweendeck 5 itself, which is dimensioned and shaped so as to extend between tweendeck supports 16 on the opposite walls in the cargo space. In the Figures the tweendeck 5 is preferably placed onto the sidewalls of the cargo space 3 on top of the folding tweendeck supports 16 so that the tweendeck 5 extends between the tweendeck supports 16 on the opposite sides of the cargo space. Such tweendeck supports 16, which are turned towards the sidewalls of the cargo space 3, enable to obtain substantially even cargo space 3 walls as well as a cargo space that is easier to load, particularly when no tweendecks 5 are used.

The tweendeck may preferably, but not necessarily, be such a tweendeck 5, onto which also other kinds of goods than reels 1 intended to be shipped onboard the ship 2 can be placed. Naturally there may be more of such tweendecks 5. The tweendeck 5 can also be formed of several tweendeck portions 10, as shown for example in FIG. 2.

A ship 2 provided with the arrangement of the invention can also be used for transporting reels 1 by means of another method or in accordance with another arrangement. These reels 1 can for example be placed at the bottom 6 of the cargo space.

The arrangement of the invention preferably comprises fastening points (not shown) for load binding ropes (not shown) or the like, the fastening points being placed onto the tweendeck 5. The load binding ropes prevent the reels 1 from moving in the reel holders 4 when the ship 2 is moving.

In the Figures, the tweendeck 5 is placed beneath a weather deck 7 level. Thus, in the arrangement according to the Figures, the weather deck 7 is arranged to prevent the reels 1 from rising from the reel holders 4 when the weather decks 7 close the cargo space 3 of the ship. The distance between the tweendeck 5 and the weather deck 7 is selected such that the reels 1 are not able to rise from or exit the reel holders 4 owing to the ship's motions, for example when the ship 2 moves downwards in rough seas. The distance between the tweendeck 5 and the weather deck 7 depends for example on the diameter of the reels 1 to be shipped onboard the ship 2 and on the structure of the reel holder 4, in other words on how high the reel holder 4 lifts the reel 1 from the surface of the tweendeck 5 turned against the weather deck 7. The distance between a lower surface 8 of the weather deck 7 and the reels 1 is thus preferably as small as possible. Alternatively the lower surface 8 of the weather deck 7 can be fastened to the reels 1 in such a manner that the weather deck 7 presses the reels 1 or is placed against them.

The weather deck 7 is preferably fastened (locked) to the frame of the ship 2 more efficiently than usual in such a manner that the weather deck 7 endures the strain and the load caused by the reels 1 when the reels 1 move upwards as the ship 2 moves downwards in rough seas.

The lower surface 8 of the weather deck 7 is preferably substantially even. This makes it easier to hold the reels 1 in position in the reel holders 4 by means of the weather deck 7.

The lower surface 8 of the weather deck 7 is preferably provided with a flexible coating 9 arranged to protect the lower surface 8 of the weather deck 7. The flexible coating 9 comprises preferably rubber.

Figure 2:
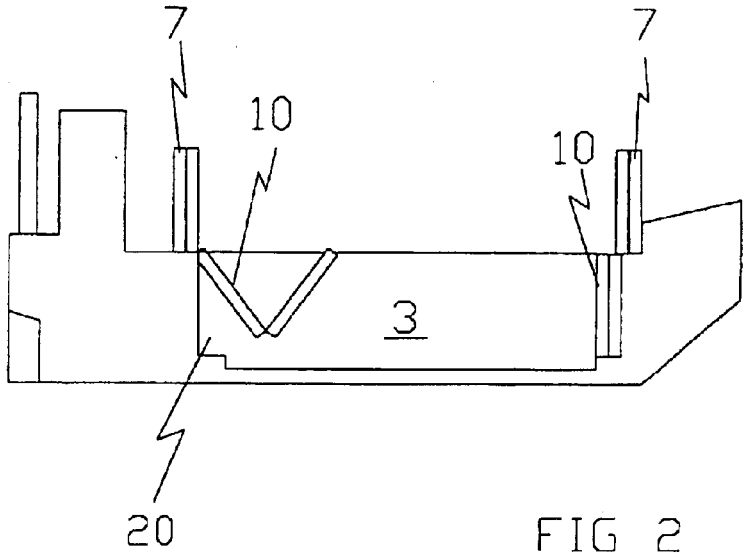
FIG. 2 shows an arrangement in which a tweendeck is formed of several tweendeck portions and in which the tweendeck can be folded together.

FIG. 2 shows a ship 2 comprising a tweendeck arrangement, in which the tweendeck 5 formed of several tweendeck portions 10 can be turned in such a manner that it forms at least partly the wall of the ship's cargo space 3, in other words is stowed to the sides/ends of the ship's cargo space 3. In FIG. 2 the end of the cargo space 3 comprises a storage space 20 for the tweendecks. Such an arrangement also protects the reel holders 4 when they are not used or when cargo is placed into the cargo space 3 beneath the tweendeck 5 or when cargo is unloaded from there. Other mechanisms can also be used to turn the tweendeck 5.

The tweendeck 5 preferably comprises a sealing arrangement (not shown) arranged to prevent the bulk goods transported in the ship's cargo space 3 from moving between the tweendeck 5 and the wall of the ship's cargo space 3, for example to the storage space 20, to dirty or possibly to break the reel holders 4. Consequently the cargo space 3 of the ship need not necessarily be washed after shipping bulk cargo, and may instead be loaded immediately.

The arrangement of the invention preferably comprises a hydraulic arrangement (not shown) for turning the tweendeck 5. Alternatively the tweendecks 5 can be turned in another way.

FIG. 2 shows an arrangement, in which the tweendeck 5 is formed of several tweendeck portions 10 that allow the tweendeck 5 to be folded together. The tweendeck portions 10 are preferably fastened to one another using a joint (not indicated with a reference numeral). Such an arrangement can be used to simply fold aside the tweendeck 5 of a large cargo space 3 in order to load the part of the ship's cargo space 3 beneath the tweendeck 5 and to unload the cargo therein. The tweendeck portions 10 in FIG. 2 are preferably dimensioned so that the weather deck 7 can be closed when it is turned towards the storage space 20.

FIGS. 4*a* to 4*e* show an arrangement for placing the tweendeck portions 10 into the cargo space 3, where a lifting arm arrangement 11 is arranged for placing the tweendeck portions 10 into the cargo space 3. A single tweendeck portion 10 preferably comprises two such lifting arm arrangements 11 placed on the opposite side of the tweendeck portions 10. One tweendeck portion 10 may weigh approximately 40 tons, and therefore it is preferable to use two lifting arm arrangements 11. If a tweendeck portion 10 comprises two lifting arm arrangements 11 it preferably also comprises a synchronization arrangement (not shown) that allows the lifting arm arrangements 11 to turn simultaneously and at an equally high speed.

FIGS. 4*a* to 4*e* show the weather decks 7 in a state where they are turned upwards, for example in order to load the ship.

Figure 4A:
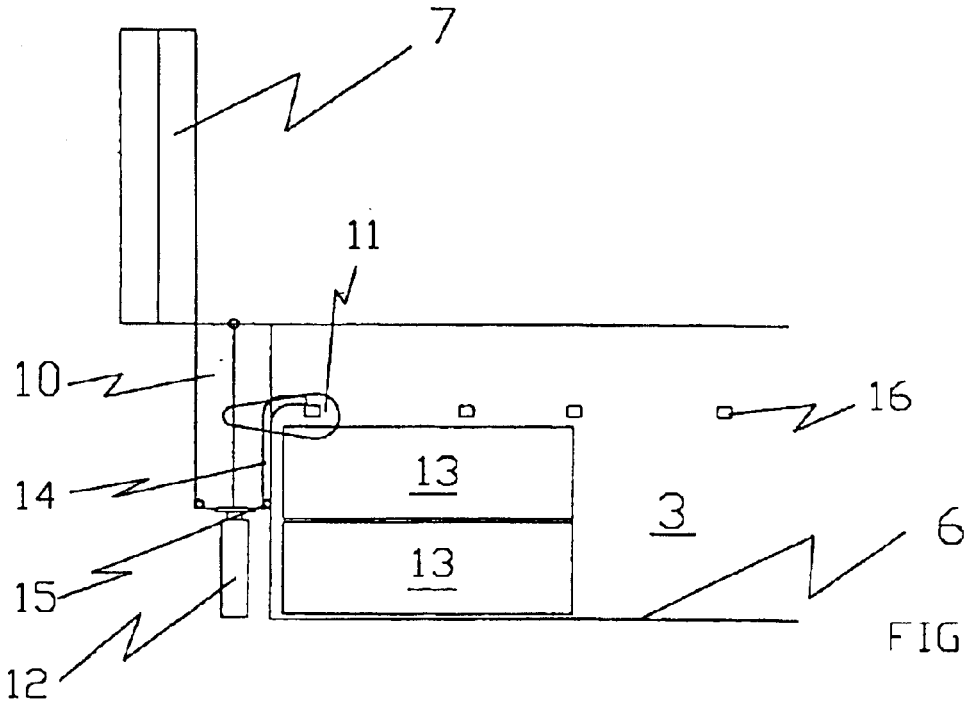
FIGS. 4*a* to 4*e* show an arrangement for placing the tweendeck portions in position into the cargo space.

FIG. 4*a* illustrates a situation in which the tweendeck portions 10 are substantially vertical in the other end of the cargo space 3. The Figure also shows by way of example two containers 13 loaded into the ship's cargo space 3 in such a manner that they are placed beneath the tweendeck 5, when the tweendeck portions 10 are placed in position at a distance from the bottom 6 of the ship's cargo space. In the Figure, a storage space 20 is made for the tweendeck portions 10 in the ship's cargo space 3, and stored therein said portions will not take up space in the cargo space 3 when not in use. The arrangement of the Figure also includes an arrangement (not indicated with a reference numeral) for lifting the tweendeck portions from the storage space 20. In the Figure the arrangement comprises a hydraulic cylinder 12 and a tweendeck portion control arrangement (not indicated with a reference numeral) arranged to direct the tweendeck portions 10 from the storage space 20 to the cargo space 3 so that the tweendeck portions will not damage the cargo placed beneath the tweendeck portions 10, containers 13 in the Figure. In the Figure the tweendeck portion control arrangement comprises rails 14, in which a control roll 15 fastened to the tweendeck portion 10 is arranged to move when the hydraulic cylinder 12 and the lifting arm arrangement 11 lift the tweendeck portions 10.

The Figure shows such an arrangement that comprises several such control rolls 15. The lifting arm arrangement 11 preferably comprises a hydraulic arrangement for turning the tweendeck portions 10 by means of the lifting arm arrangement 11, the hydraulic arrangement being arranged to directly control the tweendeck portions 10 or the lifting arm arrangement 11.

The arrangement in FIG. 4*a* is preferably made into a two-step arrangement in such a manner that the hydraulic cylinder 12 lifts at first the tweendeck portions 10 upwards and thereafter the lifting arm arrangement 11 starts to turn the tweendeck portions 10 into position.

FIGS. 4*a* to 4*e* also illustrate tweendeck supports 16, on which the tweendeck portions 10 can be supported. The tweendeck supports 16 are preferably such that when not in use the sides of the cargo space 3 are substantially even, i.e. the tweendeck supports 16 do not protrude from the sides of the cargo space 3. This makes it easier to load the cargo space 3. The tweendeck supports 16 preferably comprise a hydraulic or manual arrangement which allows the tweendeck supports 16 arranged either to the tweendeck portions 10 or to the cargo space or to both of them to be placed into such a position that the tweendeck portions 10 can be placed on top of the tweendeck supports 16. Said supports 16 are preferably mechanically controlled in such a manner, that when the tweendeck portion 10 approaches the support 16, the support 16 is automatically controlled into the supporting position thereof.

Figure 4B:
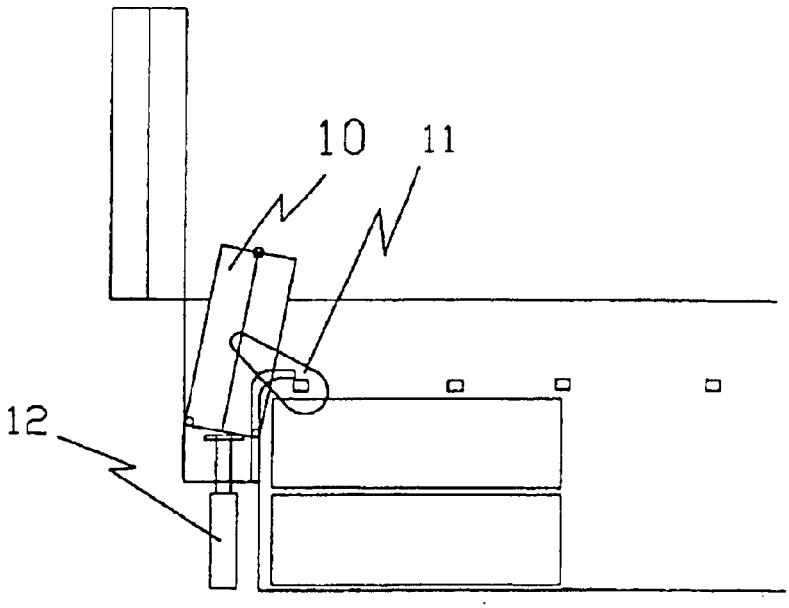

FIG. 4*b* shows the situation after FIG. 4*a*, in which the hydraulic cylinder 12 has lifted the tweendeck portions 10 slightly upwards, and the lifting arm arrangement 11 starts to lift, or turn, the tweendeck portions 10 single-handed into the cargo space 3.

Figure 4C:
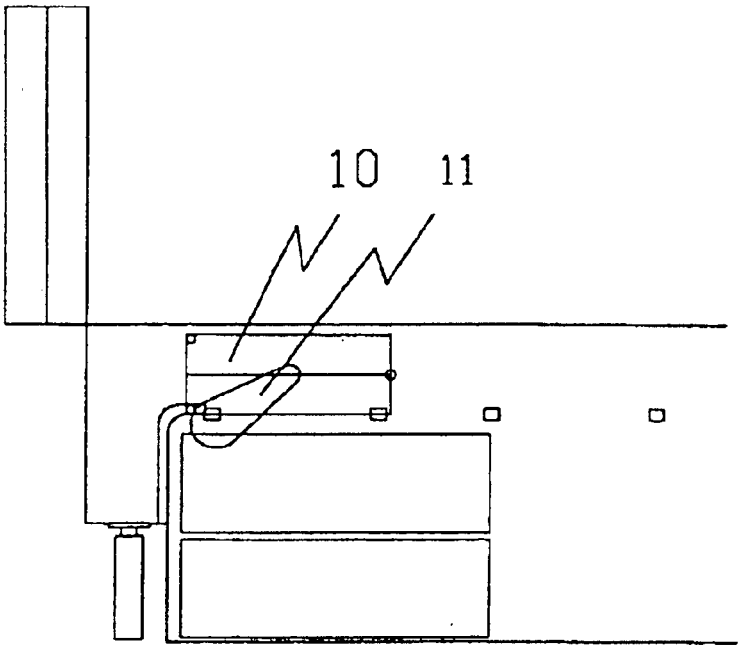

FIG. 4*c* illustrates the situation after FIG. 4*b*, in which the lifting arm arrangement 11 has turned the tweendeck portions 10 in the cargo space 3 into position, on top of the containers 13 beneath the tweendeck portions 10.

Figure 4D:
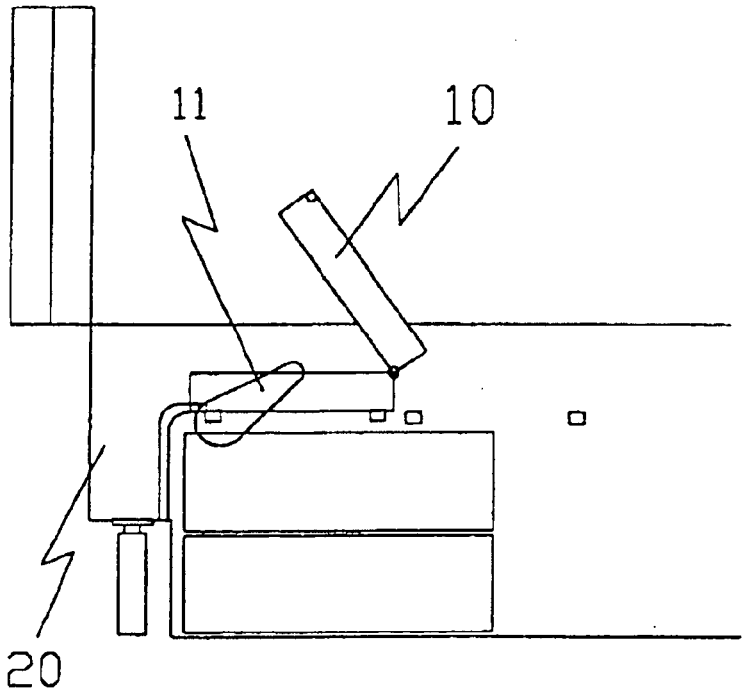

FIG. 4*d* shows the situation after FIG. 4*c*, in which the folding arrangement of the tweendeck portions starts to turn the tweendeck portions 10 apart so as to place them next to one another in the ship's cargo space 3 substantially at the same distance from the bottom 6 of the ship's cargo space.

Figure 4E:
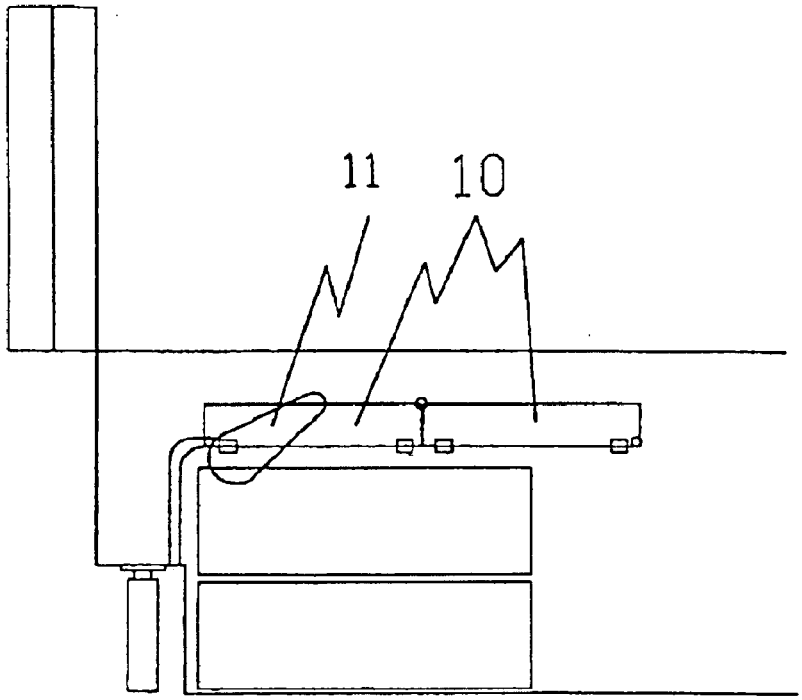

FIG. 4*e* illustrates the situation after FIG. 4*d*, in which the folding arrangement of the tweendeck portions 10 has turned the tweendeck portions 10 such that they are placed next to one another in the ship's cargo space 3 substantially at the same distance from the bottom 6 of the ship's cargo space. The reels 1 can thereafter be placed into the reel holders 4 on the tweendeck portions 10.

FIGS. 5*a* to 5*f* show an arrangement for placing the tweendeck portions 10 into the cargo space 3 where the tweendeck portions 10 can be directed into position in the ship's cargo space 3 by means of the tweendeck portion control arrangement. In the Figure, a storage space 20 is created for the tweendeck portions 10 in the ship's cargo space 3, and stored therein said tweendeck portions will not take up space in the cargo space 3 when not in use. The arrangement of the Figure also includes an arrangement for lifting the tweendeck portions 10 from the storage space 20, which in the Figure comprises a hydraulic cylinder 12. In the Figure, the tweendeck portion control arrangement comprises rails 14, in which control rolls 15 fastened to the tweendeck portions 10 are arranged to move. The tweendeck portions 10 are preferably moved in the tweendeck portion control arrangement using a hydraulic arrangement (not shown).

FIGS. 5*a* to 5*f* also show the weather decks 7 in a state where they are turned upwards in order to load the ship.

The Figures also illustrate the tweendeck supports 16, on which the tweendeck portions 10 can be supported.

The tweendeck supports 16 are preferably such that when not in use the sides of the cargo space 3 are substantially even, in other words the tweendeck supports 16 do not protrude from the sides of the cargo space 3. This makes it easier to load the cargo space 3. The tweendeck supports 16 preferably comprise a hydraulic or manual arrangement allowing the tweendeck supports 16 arranged either to the tweendeck portions 10 or to the wall of the cargo space 3 or to both of them to be placed into such a position that the tweendeck portions 10 can be placed on top of the tweendeck supports 16. Said supports 16 are preferably mechanically controlled in such a manner, that when the tweendeck portion 10 approaches the support 16, the support 16 is automatically directed to the supporting position thereof.

Figure 5A:
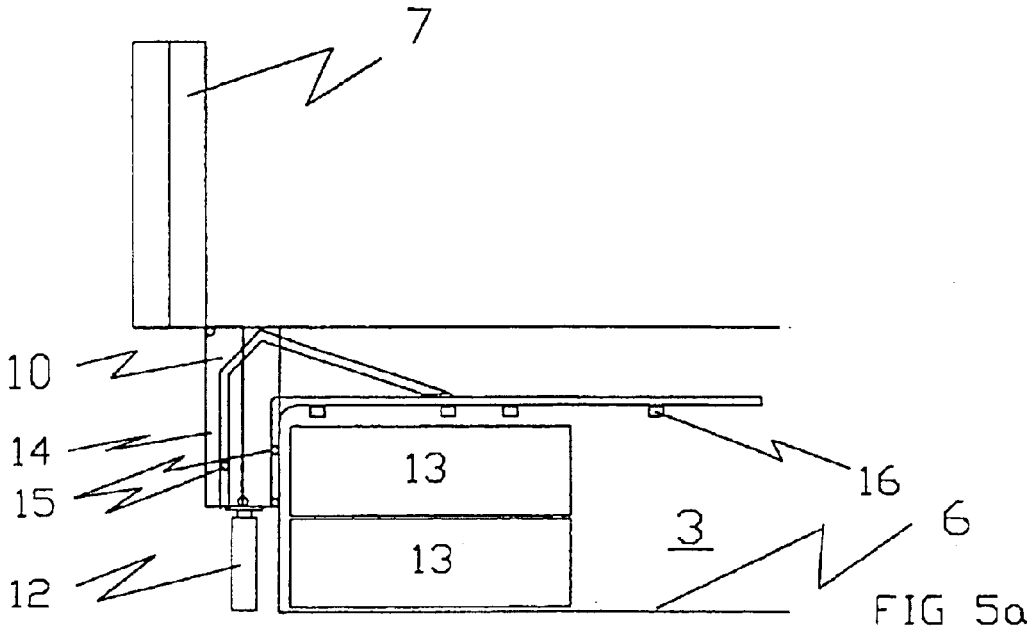
FIGS. 5*a* to 5*f* show a second arrangement for placing the tweendeck portions in position into the cargo space.
Figure 5B:
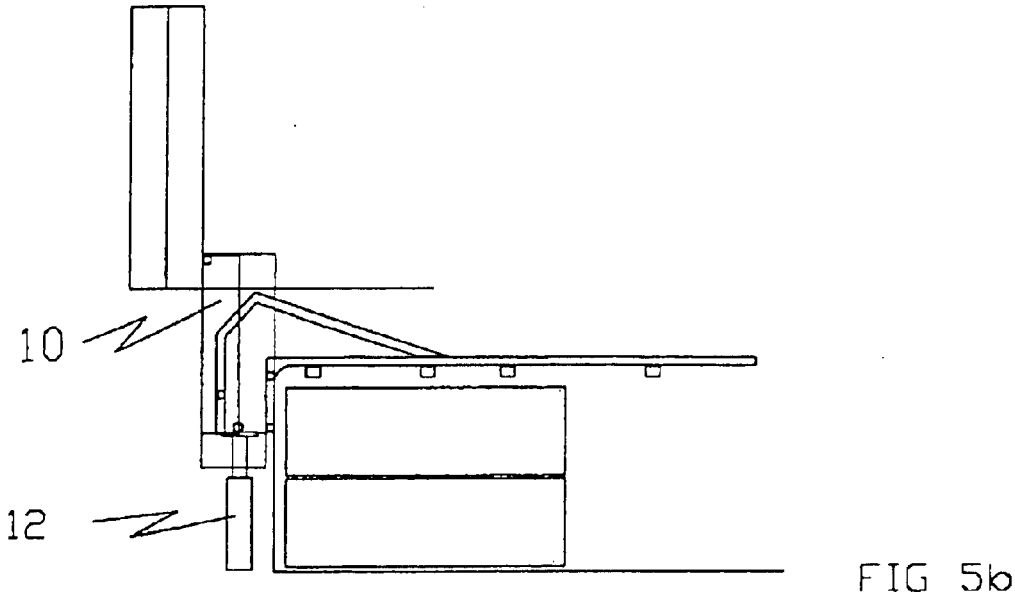

FIG. 5*b* illustrates the situation after FIG. 5*a*, in which the hydraulic cylinder has lifted the tweendeck portions slightly upwards.

Figure 5C:
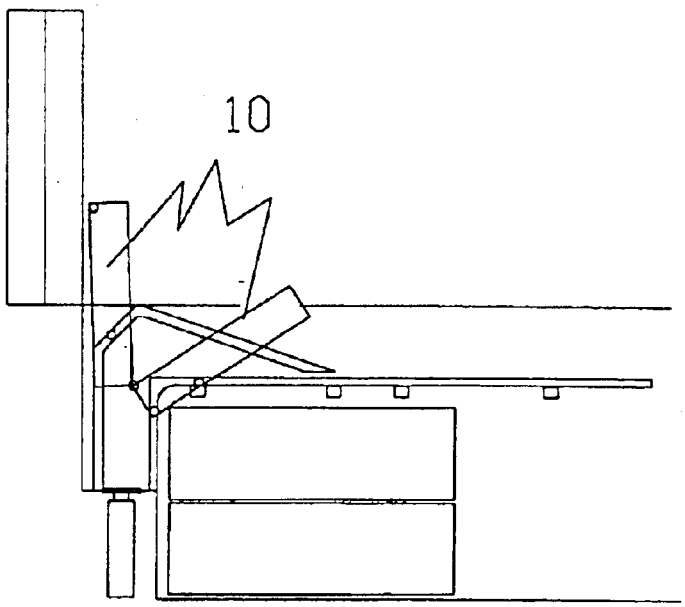

FIG. 5*c* shows the situation after FIG. 5*b*, in which a tweendeck portion 10 turns separately from a tweendeck portion 10 and starts to move, or to be directed on top of the containers 13 in the ship's cargo space 3.

Figure 5D:
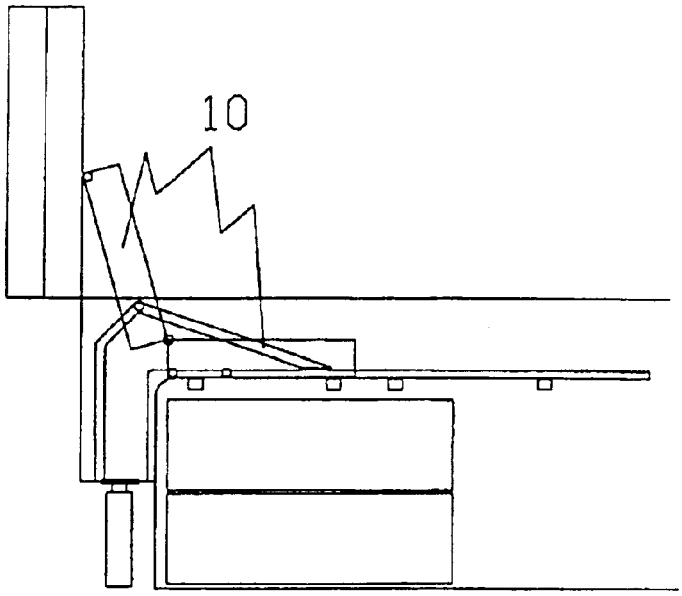

FIG. 5*d* illustrates the situation after FIG. 5*c*, in which the first tweendeck portion 10 is already placed substantially horizontally above the containers 13 in the ship's cargo space 3 and in which the second tweendeck portion 10 starts to move above the containers 13 in the ship's cargo space 3, when the tweendeck portion 10 placed substantially horizontally above the containers 13 in the ship's cargo space moves to the right in the Figure.

Figure 5E:
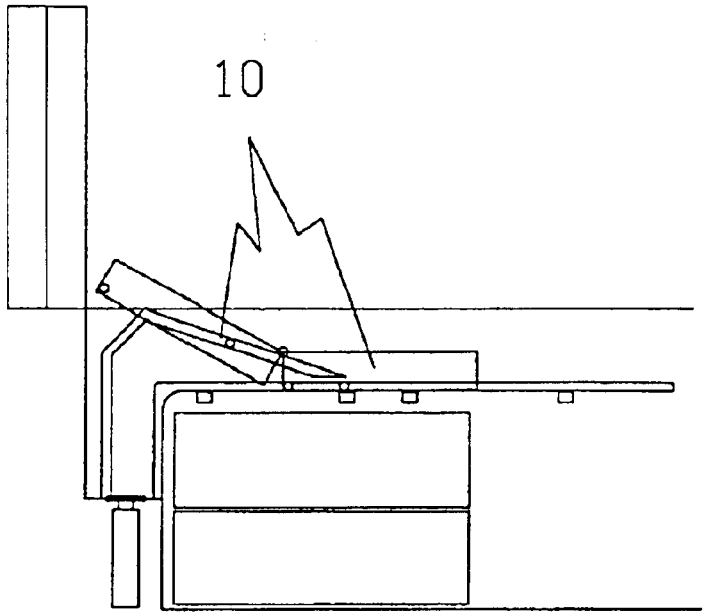

FIG. 5*e* shows the situation after FIG. 5*d*.

Figure 5F:
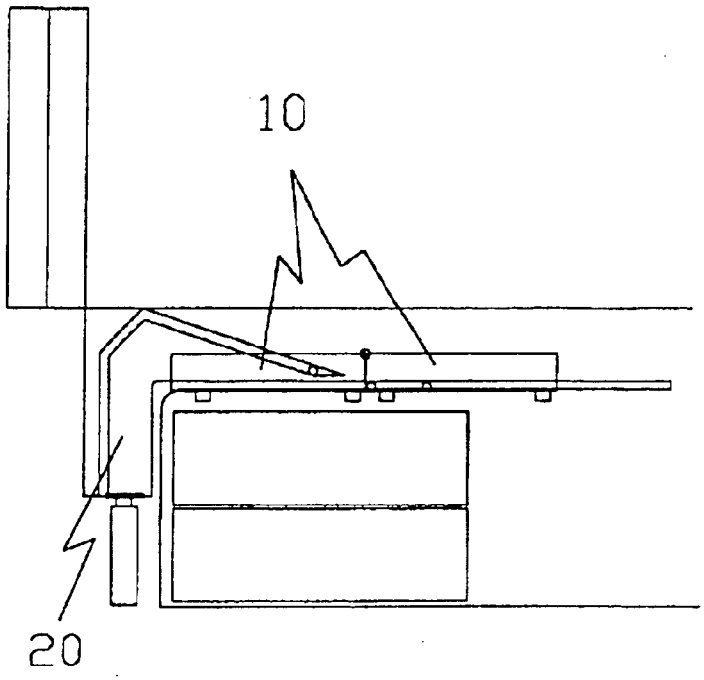

FIG. 5*f* illustrates the situation after FIG. 5*e*, in which both the tweendeck portions 10 are placed next to each other in the ship's cargo space 3 substantially at the same distance from the bottom 6 of the ship's cargo space. The reels 1 can thereafter be placed into the reel holders 4 on the tweendeck portions 10.

Figure 6:
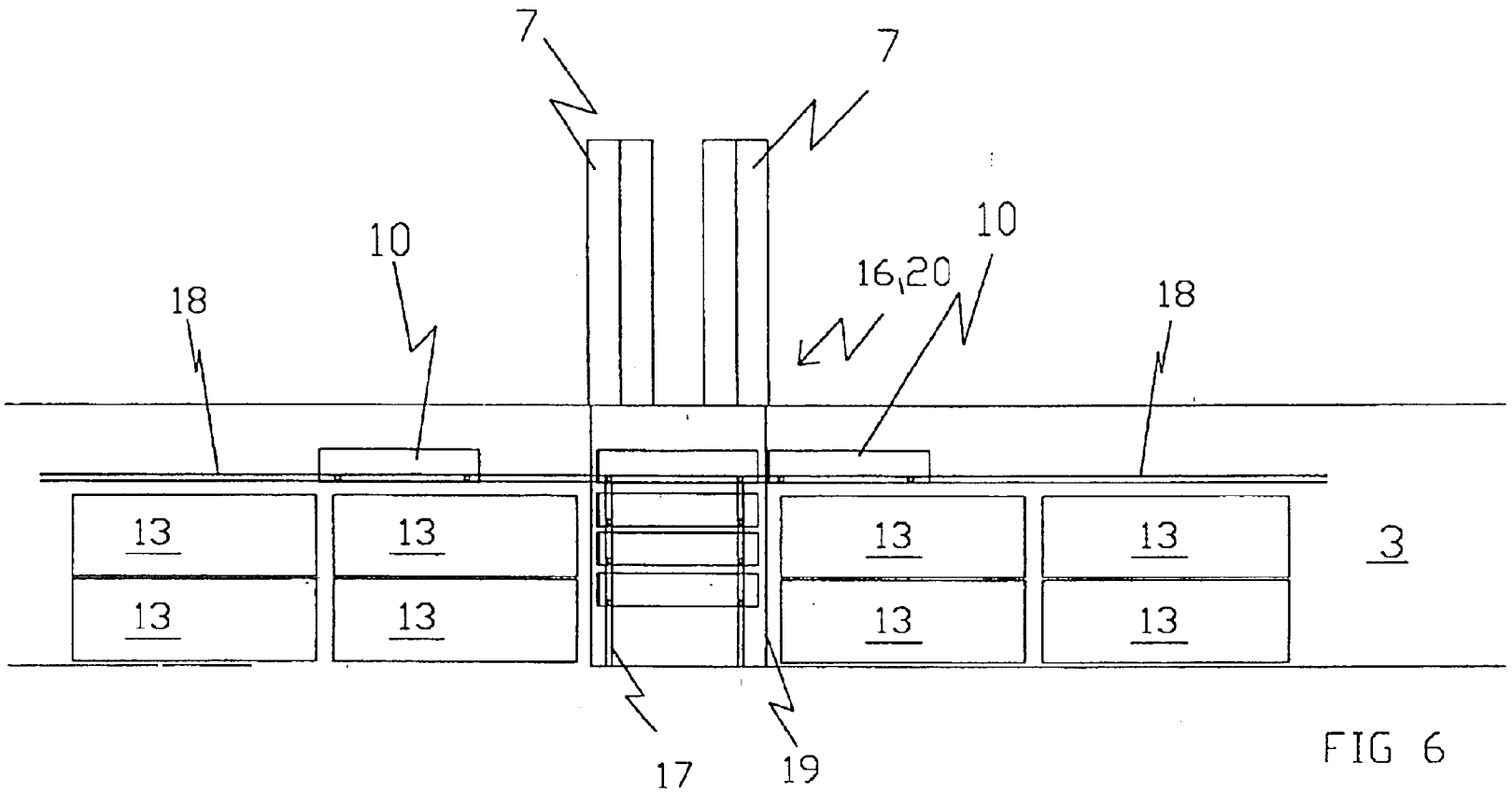
FIG. 6 shows a third arrangement for placing the tweendeck portions in position into the cargo space.

FIG. 6 shows an arrangement for placing the tweendeck portions 10 into the cargo space 3 in which the tweendeck portions 10 are placed above each other into a magazine 16 of the tweendeck portions forming the storage space 20. In FIG. 6 the cargo space of the ship is also divided into two cargo space compartments (not indicated with a reference numeral) and the storage space 20 is located between the cargo space compartments.

The magazine 16 comprises vertical controllers 17 arranged to control the tweendeck portions 10 in the vertical direction. The upper part of the ship's 2 cargo space 3 comprises horizontal controllers 18. The tweendeck portion 10 can thus be mounted into position in the ship's cargo space 3 by lifting said portion at first in the magazine 16 onto the level of the horizontal controllers 18, and thereafter the tweendeck portion 10 is horizontally moved to its correct position in the ship's cargo space 3. The magazine 16 is provided with a lift arrangement (not shown in the Figure) for lifting and correspondingly lowering the tweendeck portions. The magazine 16 is preferably separated from the ship's cargo space 3 with a partition wall 19 that aims to protect the tweendeck portions 10 when they are stored in the magazine 16.

FIG. 6 also shows the weather decks 7 in a state where they are turned upwards in order to load the ship.

The invention also relates to a method for shipping the reels 1 onboard the ship 2 where the reels 1 are at least partly placed into the ship's cargo space 3.

The method employs a reel holder 4 that holds the reel 1 placed therein substantially in position at least in the horizontal and downward direction as regards the ship 2. The reel holder 4 is arranged to the tweendeck 5 in the ship's cargo space 3, the tweendeck being placed at a distance from the bottom 6 of the ship's cargo space 3, closer to the metacentre of the ship 2 than to the bottom 6 of the cargo space.

In the method of the invention the reels 1 are preferably placed in such reel holders 4, which are arranged beneath the weather deck or decks 7 and the reels 1 are kept in the reel holders 4 by means of said weather deck or decks 7.

When loading the ship 2 it is possible that the reel 1 is at first placed in and fastened to the reel holder 4 and that the reel 1 is then lifted together with the reel holder 4 as a single unit onto the ship 2 onto the tweendeck 5 in the cargo space thereof, and thereafter said unit is fastened to the tweendeck 5. The reel holder 4 and the tweendeck 5 may have for example compatible fasteners (not shown) for fastening the reel holder 4 to the tweendeck 5.

It is obvious for those skilled in the art that the ship may comprise several of the above tweendeck arrangements for placing the tweendeck portions 10 into the cargo space 3.

It is also obvious for those skilled in the art that the method and arrangement for shipping reels onboard a ship 2 may apply the preferred embodiments of the tweendeck and/or the tweendeck arrangement of the invention.

It is further obvious for those skilled in the art that as technology advances the basic idea of the invention can be implemented in various ways. The invention and the preferred embodiments thereof are thus not restricted to the above examples but may vary within the scope of the claims.

What is claimed is:

1. A method for loading or shipping a number of heavy reels onboard a ship, or unloading the reels therefrom, the ship being arranged to hold the reels at least partly within a cargo space of the ship, comprising the steps of:

using a reel holder to hold reels substantially in position at least in a horizontal direction and in a downward direction, and securing said reel holder, at least under shipping conditions, stationary to a tweendeck structure arranged in said cargo space at such a distance above a bottom of said cargo space that a space for other cargo is provided under said tweendeck structure, and placing the reels into said reel holder and keeping the reels in the reel holder by arranging a movable weather deck portion to a position above said reel holder.

2. A method as claimed in claim 1, wherein, for loading purposes, the reels are first placed into said reel holder and thereafter the reels are placed together with the reel holder onto said tweendeck structure in the ship's cargo space and are subsequently secured to the tweendeck structure.

3. The method of claim 1, wherein the reels weigh 30 to 35 tons and are heavier relative to the other cargo.

4. An arrangement for loading or shipping a number of heavy reels onboard a ship, or unloading the reels therefrom, the ship being arranged to hold the reels at least partly in a cargo space of the ship, the arrangement comprising a reel holder, which holds the reels substantially in position at least in a horizontal direction and in a downward direction, wherein the reel holder, is permanently stationary and secured to a tweendeck structure in the ship's cargo space, which tweendeck structure is positioned, in a loading position, at a distance above a bottom of said cargo space to provide space for other cargo under said tweendeck structure.

5. An arrangement as claimed in claim 4, wherein said reel holder forms an integral portion of said tweendeck structure.

6. An arrangement as claimed in claim 4, further comprising a movable weather deck portion that is movable into a position above said reel holder, to prevent thereby the reels from rising from the reel holder.

7. An arrangement as claimed in claim 6, wherein the surface of said movable weather deck portion facing the reel holder is substantially planar, when the movable weather deck portion is in a position above the reel holder.

8. An arrangement as claimed in claim 4, wherein said tweendeck structure is detachable from said loading position.

9. An arrangement as claimed in claim 4, further comprising an arrangement for moving said tweendeck structure between a storage space and said loading position.

10. An arrangement as claimed in claim 9, further comprising a weather deck portion movable into a position closing said cargo space from above, when said tweendeck structure is in said storage space.

11. An arrangement as claimed in claim 9, further comprising a rail means in the ship and rotatable elements attached to the tweendeck structure, said rotatable elements being arranged to move along the rail means.

12. An arrangement as claimed in claim 9, further comprising a means for turning said tweendeck structure into a substantially vertical position in said storage space.

13. An arrangement as claimed in claim 12, wherein said means for turning the tweendeck structure are operable to bring the tweendeck structure into such a vertical position to form, at least partly, a wall in said cargo space.

14. An arrangement as claimed in claim 9, wherein said tweendeck structure is formed of several tweendeck portions.

15. An arrangement as claimed in claim 14, wherein said tweendeck portions are joined together by a hinge mechanism allowing said tweendeck structure to be folded together.

16. An arrangement as claimed in claim 9, wherein said cargo space includes several cargo space compartments, said storage space being located between two adjacent cargo space compartments.

17. An arrangement as claimed in claim 4, further comprising tweendeck supports at opposite sidewalls of said cargo space and wherein said tweendeck structure is located on top of said tweendeck supports.

18. An arrangement for loading or shipping a number of heavy reels onboard a ship, or unloading the reels therefrom, the ship being arranged to hold the reels at least partly in a cargo space of the ship, the arrangement comprising a reel holder, which holds the reels substantially in position at least in a horizontal direction and in a downward direction, wherein the reel holder, at least under shipping conditions, is stationary secured on a tweendeck structure in the ship's cargo space, which tweendeck structure is positioned, in a loading position, at a distance above a bottom of said cargo space to provide space for other cargo under said tweendeck structure, and further comprising a movable weather deck portion that is movable into a position above said reel holder, to prevent the reels from rising from the reel holder, wherein the surface of said movable weather deck portion facing the reel holder is provided with a flexible coating.

19. An arrangement for loading or shipping a number of heavy reels onboard a ship, or unloading the reels therefrom, the ship being arranged to hold the reels at least partly in a cargo space of the ship, the arrangement comprising a reel holder, which holds the reels substantially in position at least in a horizontal direction and in a downward direction, wherein the reel holder, at least under shipping conditions, is stationary secured on a tweendeck structure in the ship's cargo space, which tweendeck structure is positioned, in a loading position, at a distance above a bottom of said cargo space to provide space for other cargo under said tweendeck structure, and further comprising an arrangement for moving said tweendeck structure between a storage space and said loading position, wherein said tweendeck structure is formed of several tweendeck portions, wherein said storage space is dimensioned to allow said tweendeck portions to be placed one upon another in the storage space.

20. A tweendeck and a reel holder combination structure for use as a transport support for heavy reels in sea transport, said combination structure comprising:

a tweendeck portion and reel holders with means for preventing reels placed therein from moving at least in a horizontal direction and in a downward direction, said combination structure being securable, in a cargo space of a ship, at such a distance above a bottom of said cargo space that a space for other cargo is provided under said combination structure, the reel holders of said combination structure being permanently stationary secured on the tweendeck portion of the combination structure.

21. A combination as claimed in claim 20, wherein said combination structure is dimensioned and shaped to fit between opposite walls of a cargo space in a ship.

22. A combination as claimed in claim 20, wherein the reel holders of said combination structure are formed as an integral portion of the tweendeck portion of said combination structure.

23. A combination as claimed in claim 20, wherein the reel holders are provided with a damping coating on surfaces being in contact with a reel placed in the reel holder.

24. A combination as claimed in claim 20, wherein, for holding reels, the reel holders include two reel supporting surfaces inclined against each other.

* * * * *